US009192274B1

(12) United States Patent
Li et al.

(10) Patent No.: US 9,192,274 B1
(45) Date of Patent: Nov. 24, 2015

(54) FLOOR WIPING MECHANISM FOR SELF-PROPELLED FLOOR CLEANER

(71) Applicant: EGENPOWER INC., Laguna Niguel, CA (US)

(72) Inventors: Gary Li, Dong Guan (CN); Yao-Hsi Chiu, Taichung (TW)

(73) Assignee: EGENPOWER INC., Laguna Niguel, CA (US)

( * ) Notice: Subject to any disclaimer, the term of this patent is extended or adjusted under 35 U.S.C. 154(b) by 0 days.

(21) Appl. No.: 14/687,570

(22) Filed: Apr. 15, 2015

(51) Int. Cl.
*A47L 11/28* (2006.01)
*A47L 11/29* (2006.01)
*A47L 11/40* (2006.01)

(52) U.S. Cl.
CPC ..... *A47L 11/28* (2013.01); *A47L 11/29* (2013.01); *A47L 11/4036* (2013.01); *A47L 11/4047* (2013.01); *A47L 11/4069* (2013.01)

(58) Field of Classification Search
CPC ..... A47L 11/28; A47L 11/29; A47L 11/4047
See application file for complete search history.

(56) References Cited

U.S. PATENT DOCUMENTS 2,844,834 A * 7/1958 Nishioka ..... 15/99
3,945,078 A * 3/1976 Acquaro ..... 15/99
8,555,449 B2 * 10/2013 Garcia ..... 15/98

FOREIGN PATENT DOCUMENTS

CN 201308449 Y 9/2009
CN 101647681 2/2010

* cited by examiner

*Primary Examiner* — Randall Chin
(74) *Attorney, Agent, or Firm* — Muncy, Geissler, Olds & Lowe, P.C.

(57) ABSTRACT

A floor wiping mechanism for mounting in the body of a self-propelled floor cleaner is disclosed to include a frame defining an opening, two rotating shafts suspending in the opening of the frame at two opposite lateral sides in a parallel manner with respective opposite ends thereof positioned in the frame, a wiping cloth made in the form of an endless belt and mounted around the two rotating shafts. When the self-propelled floor cleaner is steering, the floor wiping mechanism is moved with the self-propelled floor cleaner, causing the wiping cloth to wipe the floor.

7 Claims, 3 Drawing Sheets

FLOOR WIPING MECHANISM FOR SELF-PROPELLED FLOOR CLEANER

BACKGROUND OF THE INVENTION

1. Field of the Invention

The present invention relates to self-propelled floor cleaners and more particularly, to a floor wiping mechanism for mounting in the bottom side of the self-propelled floor cleaner body.

2. Description of the Related Art

In order to maintain a clean home environment, most people often use a broom and a dust mop to clean the floor. To busy modern people, cleaning the floor in this way is undoubtedly a very time-consuming and laborious work. So, there are many types of electric floor cleaners and self-propelled vacuum cleaners on the market. After cleaned the floor with an electric floor cleaner or vacuum cleaner, you must use a mop or drag to wipe the floor.

Although there are many mop dewatering devices for allowing users to rapidly dewater the mop without wringing the mop with the hands. However, people still need to manually clean the floor with the mop. This manner is still labor-consuming.

In order to rapidly and easily wipe the floor, China Patent 101647681 discloses a floor-mopping robot capable of mopping the floor automatically. This design of floor-mopping robot uses a DC gear motor to rotate a mop, and therefore, its structure is complicated. China Patent 201308449 discloses a floor-wiping mechanism for floor wiping machine, in which the wiping cloth towel is wound around a drive shaft, an impression roller and a guide roller, and a transmission mechanism is driven by a motor to rotate the drive shaft, thereby cycling the wiping cloth towel. This design of floor-wiping mechanism has the same drawback of complicated structure. Further, it is also troublesome to detach the wiping cloth towel.

SUMMARY OF THE INVENTION

The present invention has been accomplished under the circumstances in view. It is the main object of the present invention to provide a floor wiping mechanism for self-propelled floor cleaner, which has a simple structural arrangement and provides an optimal cleaning effect.

It is another object of the present invention to provide a floor wiping mechanism for self-propelled floor cleaner, which facilitates mounting and dismounting of a wiping cloth.

To achieve these and other objects of the present invention, a floor wiping mechanism for self-propelled floor cleaner is mounted at a bottom side of a self-propelled floor cleaner body, comprising a frame, two rotating shafts, a wiping cloth, four collars, and four pushing devices. The frame comprises an opening located in the center thereof, at least two upright connecting portions disposed at two opposite lateral sides thereof and connected to the self-propelled floor cleaner body, four accommodation chambers respectively located at the two opposite lateral sides in an opposite manner, and a notch located in each accommodation chamber in communication with the opening. The two rotating shafts are mounted in the opening at two opposite sides in a parallel manner, having respective opposite ends thereof respectively inserted through the notches and positioned in the respective accommodation chambers in such a manner that each rotating shaft has a bottom surface thereof disposed below the lowest part of a bottom side of the frame and, the extending direction of the rotating shafts is perpendicular to the moving direction of the self-propelled floor cleaner body. The wiping cloth is made in the form of an endless belt and wound round the rotating shafts. The four collars are respectively mounted on the rotating shafts at opposing ends thereof and disposed outside the wiping cloth. Further, the protruding height of each collar relative to the respective rotating shaft is larger than or equal to the thickness of the wiping cloth. The four pushing devices are respectively mounted in the accommodation chambers of the frame. Each pushing device comprises a sliding block and an elastic member. The sliding block has one end thereof stopped against one end of one respective rotating shaft. The elastic members are adapted to provide an elastic restoring force for forcing the rotating shafts toward the outside of the frame to maintain the tension of the wiping cloth.

Other advantages and features of the present invention will be fully understood by reference to the following specification in conjunction with the accompanying drawings, in which like reference signs denote like components of structure.

DETAILED DESCRIPTION OF THE INVENTION

Figure 1:
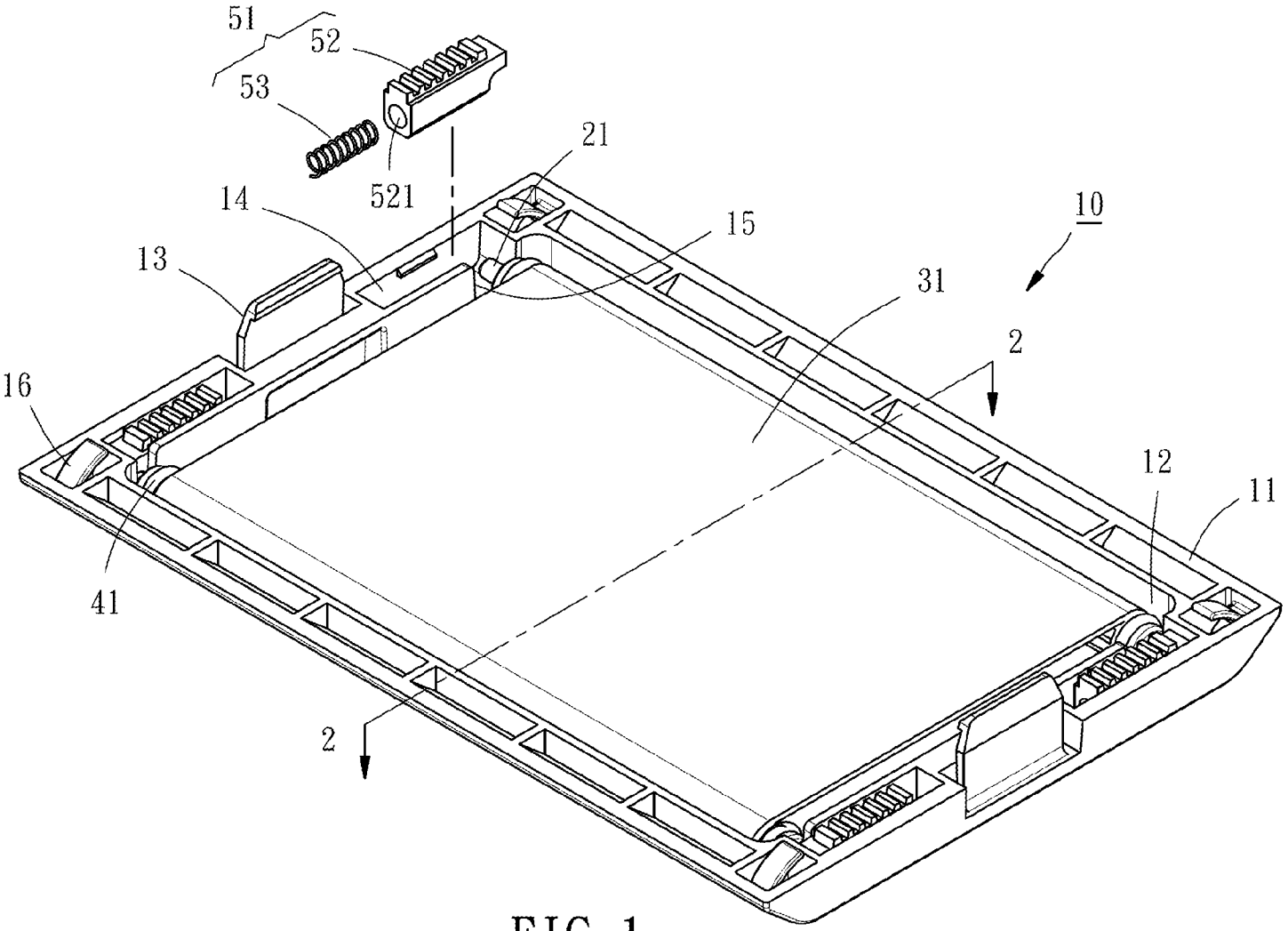
FIG. 1 is an oblique top elevational view of a floor wiping mechanism for self-propelled floor cleaner in accordance with the present invention.
Figure 2:
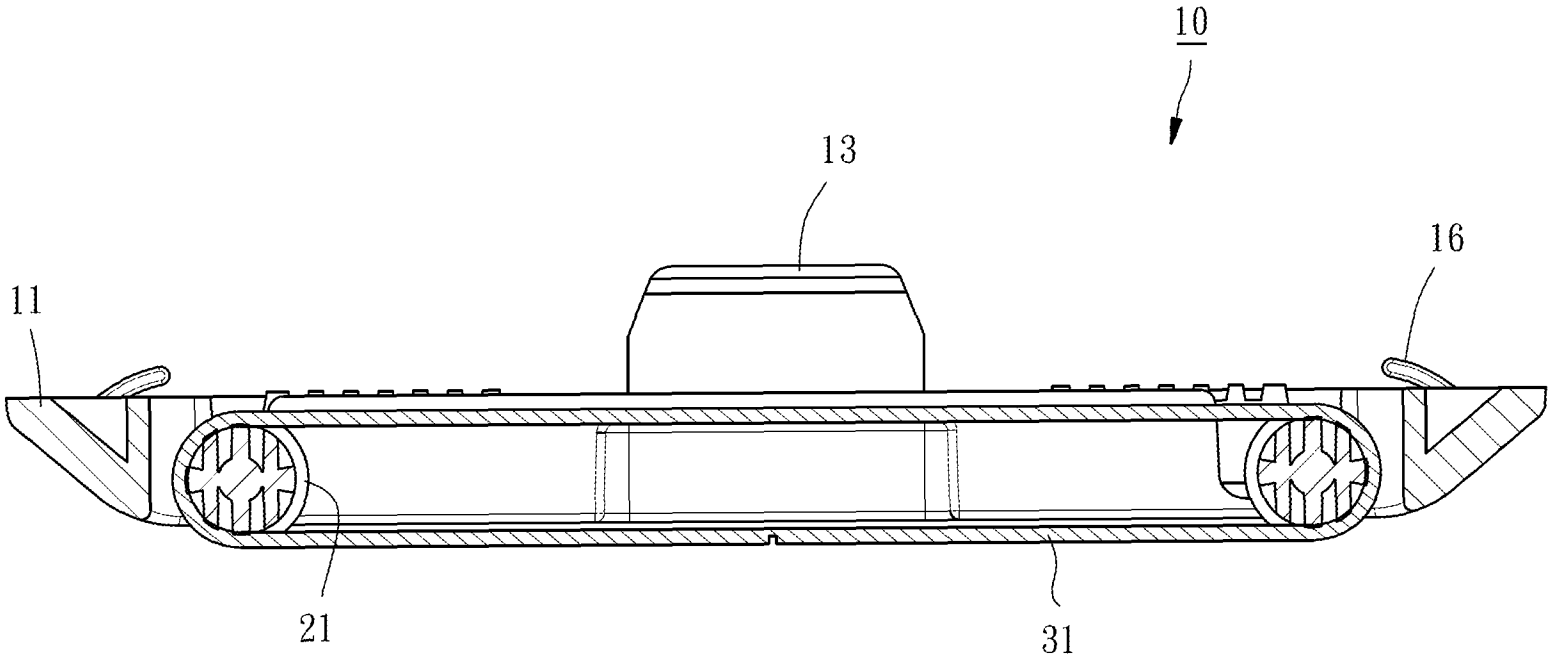
FIG. 2 is a sectional view taken along line 2-2 of FIG. 1.
Figure 3:
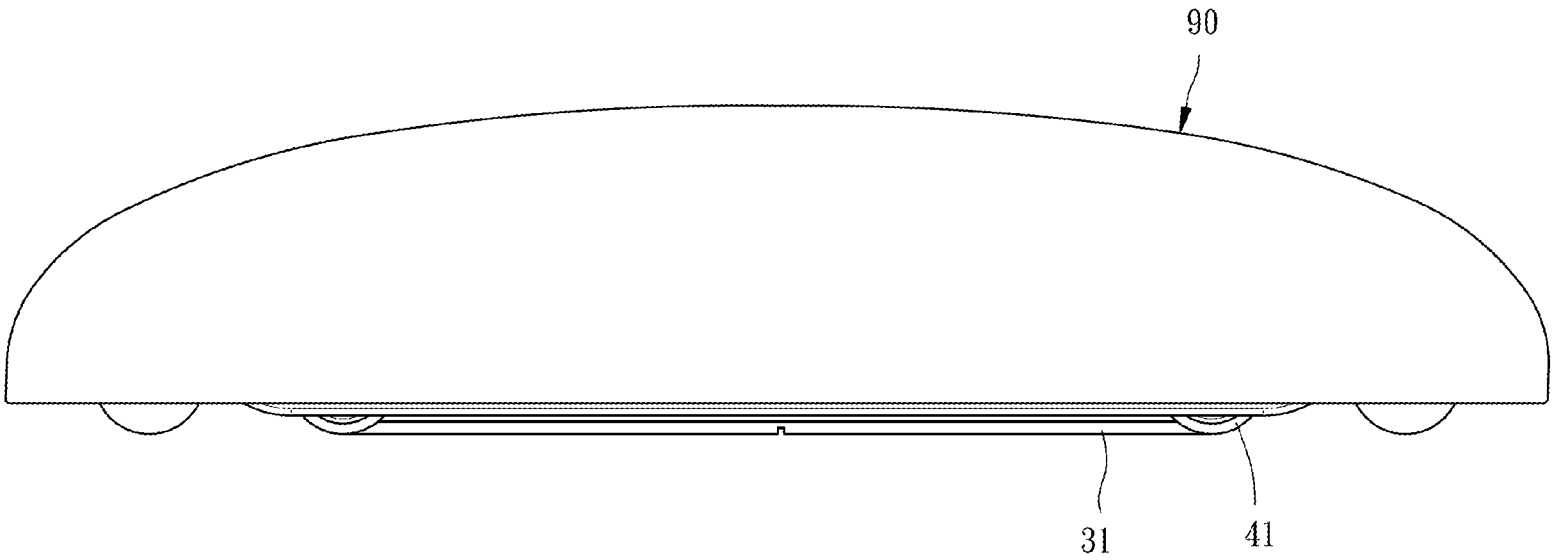
FIG. 3 is a schematic drawing illustrating the floor wiping mechanism mounted at the bottom side of a self-propelled floor cleaner body.

Referring to FIGS. 1-3, a floor wiping mechanism 10 in accordance with the present invention is shown mounted at a bottom side of a self-propelled floor cleaner body 90. The floor wiping mechanism 10 comprises a frame 11, two rotating shafts 21, a wiping cloth 31, four collars 41 and four pushing devices 51.

The frame 11 is a rectangular open frame, comprising an opening 12 located in the center thereof, at least two upright connecting portions 13 respectively located at two opposite lateral sides thereof and fastened to the self-propelled floor cleaner body 90 in such a manner that the bottom walls of the two opposite lateral sides of the frame 11 are kept at the same elevation, four accommodation chambers 14 located at the two opposite lateral sides in an opposite manner, and a notch 15 located in each accommodation chamber 14 in communication with the opening 12. In this embodiment, the frame 11 is configured to provide two upright connecting portions 13. In actual application, the frame 11 can be configured to provide more than two upright connecting portions.

The frame 11 further comprises a plurality of upwardly extending spring leaves 16 for providing an elastic restoring force. In this embodiment, four spring leaves 16 are provided and respectively located in the four corners of the frame 11.

The two rotating shafts 21 are mounted in the opening 12 at two opposite sides in a parallel manner, having the opposite ends thereof respectively inserted through the notches 15 and positioned in the respective accommodation chambers 14. Further, the bottom surface of each rotating shaft 21 is disposed below the lowest part of the frame 11. Further, the extending direction of the rotating shafts 21 is perpendicular to the moving direction of the self-propelled floor cleaner body 90.

The wiping cloth 31 is disposed in the opening 12 of the frame 11, and made in the form of an endless belt and wound round the rotating shafts 21. Further, the wiping cloth 31 has a part thereof exposed on the bottom side of the frame 11.

The collars 41 are, for example, rubber rings, respectively attached to the rotating shafts 21 at respective opposite ends of the respective rotating shafts 21 and disposed outside the wiping cloth 31. Further, the protruding height of each collar 41 relative to the respective rotating shaft 21 is larger than or equal to the thickness of the wiping cloth 31.

The four pushing devices 51 each comprise a sliding block 52 and an elastic member 53. In this embodiment, the elastic members 53 are springs. The pushing devices 51 are respectively mounted in the accommodation chambers 14 of the frame 11. Each sliding block 52 comprises an accommodation hole 521 located in one end thereof. The elastic member 53 of each pushing device 51 is positioned in the accommodation hole 521 of the associating sliding block 52. The sliding block 52 of each pushing device 51 has its opposite end stopped against one end of one respective rotating shaft 21. The elastic restoring force of the elastic members 53 enable the sliding blocks 52 to push the respective rotating shafts 21 toward the outside of the frame 11, causing the rotating shafts 21 to stretch out the wiping cloth 31, and therefore the tension of the wiping cloth 31 is maintained.

The floor wiping mechanism 10 is mounted at the bottom side of the self-propelled floor cleaner body 90 such that the spring leaves 16 of the frame 11 are abutted against the bottom side of the self-propelled floor cleaner body 90 to impart an elastic restoring upward force to the self-propelled floor cleaner body 90, causing the wiping cloth 31 and the four collars 41 of the floor wiping mechanism 10 in close contact with the floor. The effect of the spring leaves 16 is to enhance the downward force of the floor wiping mechanism 10 by means of their elastic restoring force. However, the gravity weight of the floor wiping mechanism 10 is sufficient to let the floor wiping mechanism 10 produce a downward force when it is mounted at the bottom side of the self-propelled floor cleaner body 90. In actual application, the frame 11 can be configured without the spring leaves 16.

When the self-propelled floor cleaner body 90 is steering, it carries the floor wiping mechanism 10 to move synchronously, causing the wiping cloth 31 to wipe the floor. Further, during movement of the self-propelled floor cleaner body 90, the four collars 41 are forced to rub against the floor, and the friction force thus produced between the floor and the four collars 41 can cause the rotating shafts 21 to rotate, thereby cycling the wiping cloth 31 over the floor, and thus, the floor is cleaned. By means of stopping the pushing devices 51 against respective one ends of the rotating shafts 21 to push the rotating shafts 21 toward the outside of the frame 11, the two rotating shafts 11 can stretch out the wiping cloth 31, preventing the wiping cloth 31 from wrinkling during cycling and maintaining the tension of the wiping cloth 31 to achieve optimal cleaning effects.

If user wants to detach the wiping cloth 31 for cleaning or replacement, the user can manually push the sliding blocks 52 away from the rotating shafts 21 to disengage the rotating shafts 21 from the respective pushing devices 51, and then remove the two rotating shafts 21 with the wiping cloth 31 from the frame 11, and then remove the two rotating shaft 21 from the wiping cloth 31, and thus, the wiping cloth 31 can be washed or replaced. After washing of the wiping cloth 31 or when using a new wiping cloth, attach the wiping cloth 31 to the two rotating shafts 21, and then set the respective opposite ends of the rotating shafts 21 in the respective accommodation chambers 14 of the frame 11 to let the pushing devices 51 be respectively stopped against the respective ends of the rotating shafts 21.

In conclusion, the floor wiping mechanism of the present invention has a simple structural arrangement. In application, the wiping cloth is continuously cycled to wipe the floor, enhancing the cleaning effect. When the wiping cloth becomes dirty, it can be conveniently detached for washing or replacement, enhancing ease of use.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A floor wiping mechanism mounted at a bottom side of a self-propelled floor cleaner body, comprising:

a frame comprising an opening located in the center thereof, at least two upright connecting portions disposed at two opposite lateral sides thereof and connected to said self-propelled floor cleaner body, four accommodation chambers respectively located at the two opposite lateral sides in an opposite manner, and a notch located in each said accommodation chamber in communication with said opening;

two rotating shafts mounted in said opening at two opposite sides in a parallel manner, said rotating shafts having respective opposite ends thereof respectively inserted through said notches and positioned in the respective said accommodation chambers in such a manner that each said rotating shaft has a bottom surface thereof disposed below the lowest part of a bottom side of said frame and, the extending direction of said rotating shafts is perpendicular to the moving direction of said self-propelled floor cleaner body;

a wiping cloth made in the form of an endless belt and wound round said rotating shafts;

four collars respectively mounted on said rotating shafts at opposing ends thereof and disposed outside said wiping cloth, the protruding height of each said collar relative to the respective said rotating shaft is larger than or equal to the thickness of said wiping cloth; and four pushing devices respectively mounted in said accommodation chambers of said frame, each said pushing device comprising a sliding block and an elastic member, said sliding block having one end thereof stopped against one end of one respective said rotating shaft, said elastic members being adapted to provide an elastic restoring force for forcing said rotating shafts toward the outside of said frame to maintain the tension of said wiping cloth.

2. The floor wiping mechanism as claimed in claim 1, wherein each said collar is a rubber ring.

3. The floor wiping mechanism as claimed in claim 1, wherein each said elastic member is a spring.

4. The floor wiping mechanism as claimed in claim 1, wherein said frame further comprises a plurality of spring leaves attached to the bottom side of said self-propelled floor cleaner body.

5. The floor wiping mechanism as claimed in claim 1, wherein said frame exhibits a rectangular shape.

6. The floor wiping mechanism as claimed in claim 1, wherein said frame has respective bottom walls of the two opposite lateral sides thereof kept at the same elevation.

7. The floor wiping mechanism as claimed in claim 1, wherein said wiping cloth has at least a part thereof exposed on the bottom side of said frame.

* * * * *